US008932410B2

(12) United States Patent
Ulger et al.

(10) Patent No.: US 8,932,410 B2
(45) Date of Patent: Jan. 13, 2015

(54) DISHWASHER USING OZONE WATER

(75) Inventors: Zehra Ulger, Istanbul (TR); Erman Tutkak, Istanbul (TR); Murat Elgun, Istanbul (TR); Mehmet Kaya, Istanbul (TR); Gokhan Ozgurel, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 298 days.

(21) Appl. No.: 13/126,441

(22) PCT Filed: Oct. 21, 2009

(86) PCT No.: PCT/EP2009/063764

§ 371 (c)(1),
(2), (4) Date: Apr. 27, 2011

(87) PCT Pub. No.: WO2010/049318

PCT Pub. Date: May 6, 2010

(65) Prior Publication Data

US 2011/0203620 A1 Aug. 25, 2011

(30) Foreign Application Priority Data

Oct. 27, 2008 (TR) ..... a 2008 08105

(51) Int. Cl.
*A47L 15/42* (2006.01)

(52) U.S. Cl.
CPC ..... *A47L 15/424* (2013.01)
USPC ..... 134/56 D; 134/99.2

(58) Field of Classification Search
CPC ..... A47L 15/424
USPC ..... 134/56 D
See application file for complete search history.

(56) References Cited

U.S. PATENT DOCUMENTS

| | | | | |
|---|---|---|---|---|
| 6,431,188 | B1 * | 8/2002 | Laszczewski et al. | 134/56 D |
| 2010/0000577 | A1 * | 1/2010 | Heiligenmann et al. | 134/22.11 |

FOREIGN PATENT DOCUMENTS

| | | | | |
|---|---|---|---|---|
| DE | 3000826 | A1 | 7/1981 | |
| DE | 3232057 | A1 * | 8/1982 | B08B 3/08 |
| DE | 3232057 | A1 | 3/1984 | |
| EP | 1701644 | A1 | 7/2005 | |
| WO | 2007043795 | A1 | 4/2007 | |
| WO | WO2008/055811 | A1 * | 5/2008 | A47L 15/44 |

* cited by examiner

*Primary Examiner* — Michael Barr
*Assistant Examiner* — Jason Riggleman
(74) *Attorney, Agent, or Firm* — Venjuris PC

(57) ABSTRACT

The present invention relates to a dishwasher (1) wherein ozone water is applied to improve the washing performance and to provide hygiene. The ozone gas that is generated by an ozone generator (7) located in the dishwasher (1) is mixed to the wash water by the Venturi device (8) and by means of an ozone water line (9) extending into the tub (2), of branch pipes (10, 110, 210) and of spray nozzles (N), ozone wash water is sprayed to the lower dish rack (3) or the upper dish rack (103).

8 Claims, 2 Drawing Sheets

DISHWASHER USING OZONE WATER

Figure 1:
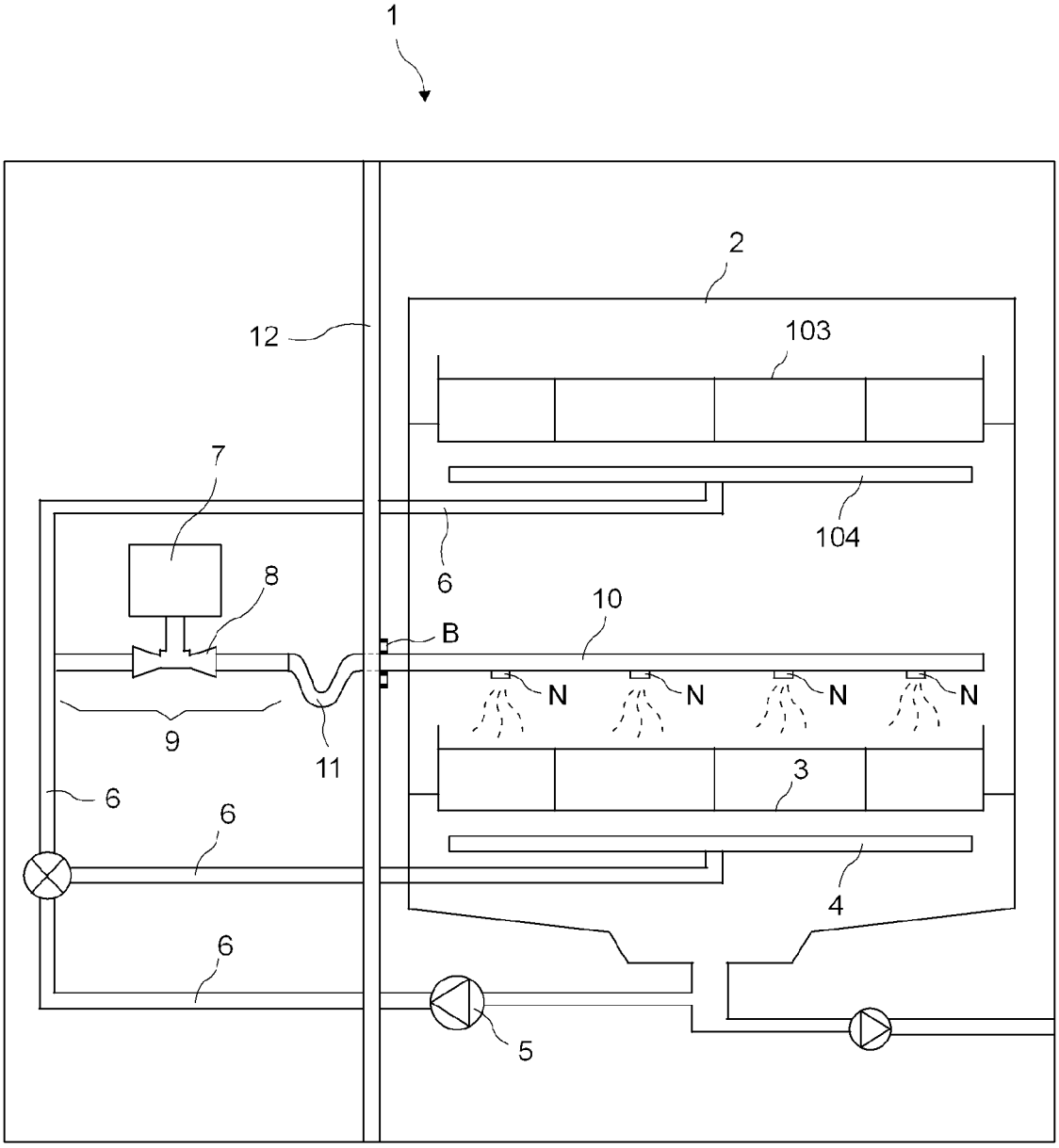

The present invention relates to a dishwasher wherein the washing operation carried out by using ozone water.

In dishwashers, ozone gas ($O_3$) having soil removal and disinfectant effects is used for increasing the effectiveness of the washing process. By means of the ozone gas used in the washing process, the amount of detergent and water consumption decreases and since the washing process can be performed at lower temperature levels, energy saving is provided. In dishwashers performing ozone wash, the ozone gas generated by an ozone generator is dissolved generally in wash water and the washing process is performed by ozone water being sent onto the dishes. In the washing process performed with ozone water, although the desired result is provided particularly in situations wherein hygiene is important, the contact of some kitchen utensils with ozone is not advised. For example, coating materials such as Teflon or paint used in some kitchen utensils such as pot and pan, low quality steel and plastic materials are deformed by the effect of ozone. Separately washing the kitchen utensils that are positively and adversely affected by the ozone gas is a solution that is not preferred by the user, since it increases the energy and time consumption.

In the Patent Document No DE3232057, an ozone generator is described that is used in washing machines and dishwashers. In the dishwasher, in the rinsing step, the ozone gas taken from the ozone generator to the washing line by means of the Venturi nozzle (vacuum pump) is dissolved in the wash water and the dishes are washed with ozone water.

In the Patent Application No EP1701644, the usage of oxygenating gases such as ozone for cleaning and disinfecting purposes in a dishwasher is described. The ozone gas is dissolved in the rinsing liquor and/or directly sent to the washing container. Furthermore, the ozone gas is mixed with cold fog generated by an ultrasonic generator and thus, the effectiveness of the ozone gas is increased.

In the Patent Application No DE3000826, in a dishwasher, ozone gas is used in the washing process. ozone gas generated by an ozone generator is mixed with water and the wash water comprising ozone gas is sent into the compartment wherein the washing process is performed by means of a sprayer.

The aim of the present invention is the realization of a dishwasher wherein ozone water is used and which enables the items that require ozone water or that do not require ozone water to be washed together.

The dishwasher realized in order to attain the aim of the present invention is explicated in the claims.

The dishwasher of the present invention comprises an ozone generator generating ozone gas to provide hygiene in the items being washed and a Venturi device used for mixing generated ozone gas with the wash water, and by means of an ozone water line and one or several branch pipes which are connected to this line and whereon spray nozzles are situated, ozone water is sent only onto the lower dish rack or only onto the upper dish rack according to the preference of the user. Thus, by performing local ozone wash in the dishwasher, the items that are desired to contact ozone and that are not desired to contact ozone are provided to be disposed to the lower dish rack and the upper dish rack separately and thus, to be washed at the same time.

In another embodiment of the present invention, the branch pipe is connected to the ozone water line by a flexible or bellows-like connection hose and the branch pipe is moved on a beam in the vertical direction and thus, is fixed above the lower dish rack or the upper dish rack in the desired position.

In another embodiment of the present invention, the dishwasher comprises two branch pipes which are connected to the ozone water line and one of which extends to the upper side of the lower dish rack and the other to the upper side of the upper dish rack, and by means of a valve, ozone water is directed only to one of the said two branch pipes.

The dishwasher realized in order to attain the aim of the present invention is illustrated in the attached figures, where:

FIG. 1—is the schematic view of a dishwasher wherein ozone wash is applied.

Figure 2:
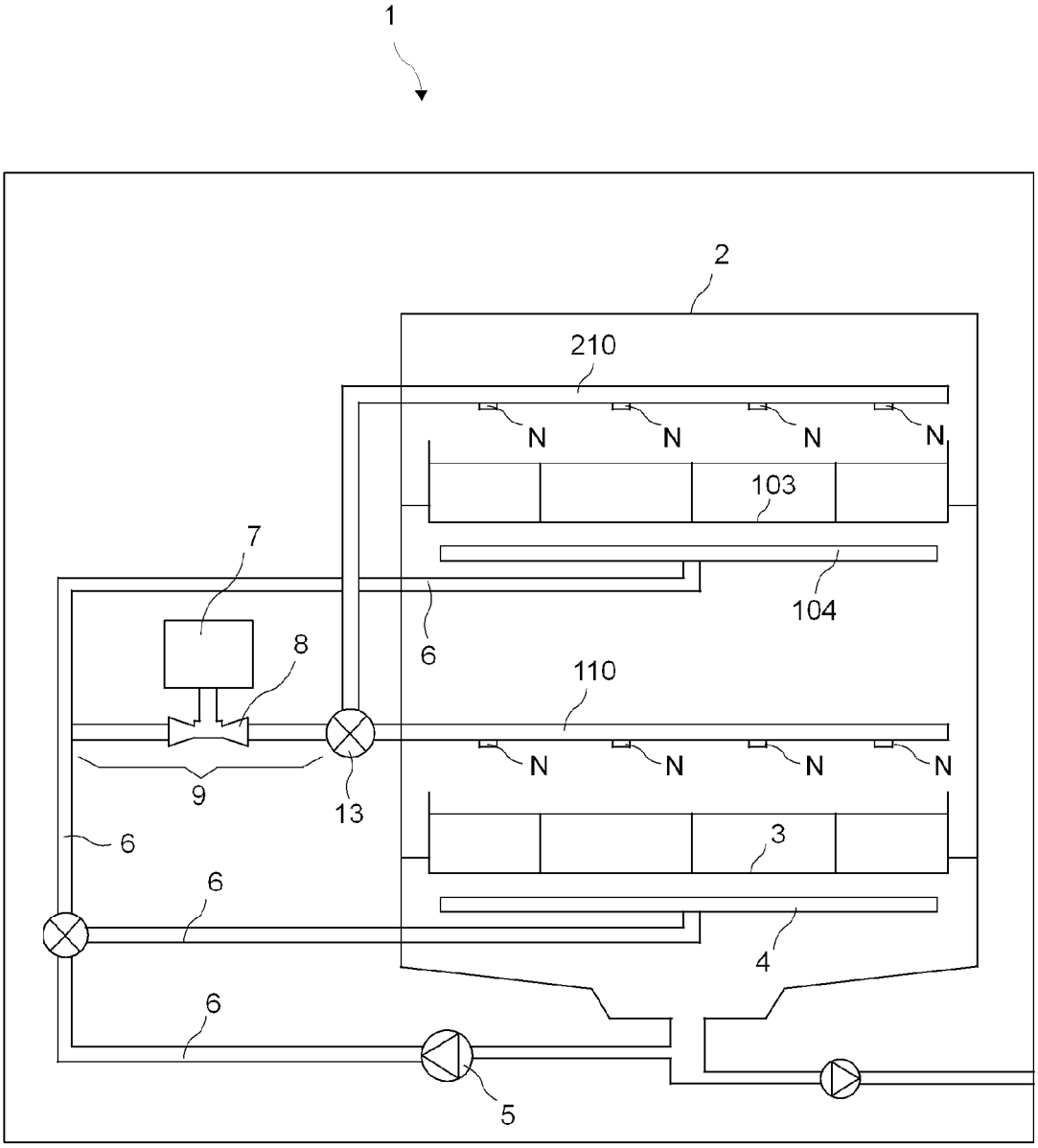

FIG. 2—is the schematic view of a dishwasher wherein ozone wash is applied in another embodiment of the present invention.

The elements illustrated in the figures are numbered as follows:

1—Dishwasher
2—Tub
3, 103—Dish rack
4, 104—Spray arm
5—Circulation pump
6—Water transmission line
7—Ozone generator
8—Venturi device
9—Ozone water line
10, 110, 210—Branch pipe
11—Connection hose
12—Beam
13—Valve The dishwasher (1) comprises a tub (2) wherein the washing process is performed, a lower dish rack (3) and an upper dish rack (103) wherein items to be washed are disposed, a lower spray arm (4) and an upper spray arm (104) spraying the wash water onto the items disposed to the dish racks (3, 103), a circulation pump (5) providing the circulation of the wash water, a water transmission line (6) providing the wash water to be carried from the circulation pump (5) to the spray arms (4, 104), an ozone generator (7) generating ozone gas that is used to increase the effectiveness of the washing process and to provide hygiene, and a Venturi device (8) connected to the ozone generator (7), used for mixing ozone gas with the wash water.

The dishwasher (1) of the present invention comprises an ozone water line (9) which extends into the tub (2) by branching out of the water transmission line (6) and to the water, which it takes from the water transmission line (6), ozone gas is fed by means of the Venturi device (8), and one or more branch pipes (10, 110, 210) connected to the ozone water line (9), sending ozone water to the lower dish rack (3) or the upper dish rack (103) by means of the spray nozzles (N) thereon according to the preference of the user.

In the dishwasher (1) of the present invention, the items that are desired to be washed with ozone water are disposed in a dish rack (3, 103) and the items that are not desired to be washed with ozone water are disposed to the other dish rack (3, 103) and by providing the branch pipes (10, 110, 210) connected to the ozone water line (9) to send ozone water only onto the lower dish rack (3) or only onto the upper dish rack (103), local ozone wash is performed in the dishwasher (1).

In an embodiment of the present invention, the dishwasher (1) comprises a branch pipe (10) connected to the ozone water line (9), extending to the upper side of the lower dish rack (3) or of the upper dish rack (103), providing ozone water to be sent only to the lower dish rack (3) or only to the upper dish rack (103) by its position being changed (FIG. 1).

In this embodiment, the dishwasher (1), furthermore, comprises a flexible connection hose (11) which is connected between the ozone water line (9) and the branch pipe (10) and which allows the location of the branch pipe (10) to be changed, and a beam (12) which provides the branch pipe (10) to be fixed above the lower dish rack (3) or the upper dish rack (103) in the desired position by means of a mounting member (B) (FIG. 1).

In another embodiment of the present invention, the dishwasher (1) comprises two branch pipes (110, 210) which provide ozone water to be sent only to the lower dish rack (3) or only to the upper dish rack (103) by the flow direction of ozone water that is carried by the ozone water line (9) being changed, and one of which extends to the upper side of the lower dish rack (3) and the other to the upper side of the upper dish rack (103) (FIG. 2).

In this embodiment, the dishwasher (1), furthermore, comprises a valve (13) which has one inlet and two outlets, the inlet of which is connected to the ozone water line (9) and the outlets of which are connected to the branch pipes (110, 210), and which provides ozone water to be directed only to one branch pipe (110 or 210) according to the choice of the user (FIG. 2).

In this embodiment, in the dishwasher (1), program options as "lower dish rack (3) ozone wash" and "upper dish rack (103) ozone wash" are present, and according to the choice of the user, ozone wash is performed in the desired dish rack (3, 103) by means of the first or second branch pipe (110, 210).

When the items that are desired to be washed with ozone water are disposed to the lower dish rack (3), on the items in the lower dish rack (3), ozone water acts from above by means of the ozone water line (9) and branch pipes (10 or 110) and water without ozone acts from below by means of the spray arm (4). In this embodiment, the items that are not desired to be washed with ozone water are disposed to the upper dish rack (103) and only water without ozone is sent to the upper dish rack (103) by means of the upper spray arm (104). Thus, items that are known as being positively affected by ozone and items that are known as being adversely affected by ozone are provided to be washed together.

When the items that are desired to be washed with ozone water are disposed to the upper dish rack (103), this time on the items in the upper dish rack (103), ozone water acts from above by means of the ozone water line (9) and branch pipes (10 or 210) and water without ozone acts from below by means of the spray arm (104). In this embodiment, the items that are not desired to be washed with ozone water are disposed to the lower dish rack (3) and water without ozone is sent to the lower dish rack (3) by means of the lower spray arm (4). After ozone water sent to the upper dish rack (103) contacts the items being washed, it loses ozone effect until it flows downwards and reaches the lower dish rack (3) and thus, it does not adversely affect the items in the lower dish rack (3).

In the dishwasher (1) of the present invention, by performing local ozone wash, the items that require ozone wash or that do not require ozone wash can be washed together during a single washing program.

The invention claimed is:

1. A dishwasher (1) comprising a tub (2) wherein the washing process is performed, a lower dish rack (3) and an upper dish rack (103) wherein items to be washed are disposed, a lower spray arm (4) and an upper spray arm (104) which spray the wash water onto the items disposed to the dish racks (3, 103), a circulation pump (5) which provides the circulation of the wash water, a water transmission line (6) which provides the wash water to be carried from the circulation pump (5) to the spray arms (4, 104), an ozone generator (7) which generates ozone gas that is used to increase the effectiveness of the washing process and to provide hygiene, and a Venturi device (8) which is connected to the ozone generator (7) and which is used for mixing the ozone gas with the wash water, and an ozone water line (9) branching out of the water transmission line (6) ozone gas is fed to the ozone water line (9) by means of the Venturi device (8), and one or more branch pipes (10, 110, 210) which extends into the tub (2) and which are connected to the ozone water line (9) sending ozone water to the lower dish rack (3) or the upper dish rack (103) by spray nozzles on the one or more branch pipes, wherein the one or more branch pipes are separate, distinct, elements from the spray arms (10, 110, 210).

2. The dishwasher (1) as in claim 1, wherein the branch pipe (10) which is connected to the ozone water line (9), which extends to the upper side of the lower dish rack (3) or of the upper dish rack (103), and which provides ozone water to be sent only to the lower dish rack (3) or only to the upper dish rack (103) by its position being changed.

3. The dishwasher (1) as in claim 1, further comprising a flexible connection hose (11) which is connected between the ozone water line (9) and the branch pipe (10), and which allows the location of the branch pipe (10) to be changed.

4. The dishwasher (1) as in claim 3, further comprising a beam (12) which provides the branch pipe (10) to be fixed above the lower dish rack (3) or the upper dish rack (103) in the desired position by means of a mounting member (B).

5. The dishwasher (1) as in claim 1, wherein two branch pipes (110, 210) which provide ozone water to be sent only to the lower dish rack (3) or only to the upper dish rack (103) by the flow direction of ozone water that is carried by the ozone water line (9) being changed, and one of which extends to the upper side of the lower dish rack (3) and the other to the upper side of the upper dish rack (103).

6. The dishwasher (1) as in claim 5, further comprising a valve (13) which has one inlet and two outlets, the inlet of which is connected to the ozone water line (9) and the outlets of which are connected to the branch pipes (110, 210), and which provides ozone water to be directed only to one branch pipe (110 or 210) according to the choice of the user.

7. The dishwasher (1) as in claim 2, further comprising a flexible connection hose (11) which is connected between the ozone water line (9) and the branch pipe (10), and which allows the location of the branch pipe (10) to be changed.

8. The dishwasher (1) as in claim 7, further comprising a beam (12) which provides the branch pipe (10) to be fixed above the lower dish rack (3) or the upper dish rack (103) in the desired position by means of a mounting member (B).

* * * * *